US005282345A

United States Patent [19]

Darcy et al.

[11] Patent Number: 5,282,345

[45] Date of Patent: Feb. 1, 1994

[54] APPARATUS FOR HANDLING A SHEET OF SEPARATOR MATERIAL

[75] Inventors: John J. Darcy, Webster; Boris Haritonoff, Geneseo; Edouard E. Langlois, Rochester; Karl V. Thomsen, Ontario, all of N.Y.

[73] Assignee: Xerox Corporation, Stamford, Conn.

[21] Appl. No.: 971,715

[22] Filed: Nov. 4, 1992

Related U.S. Application Data

[63] Continuation of Ser. No. 724,307, Jul. 1, 1991, abandoned.

[51] Int. Cl.[5] ..... B65B 35/54; B65B 63/04; B65B 25/14; B65B 61/22

[52] U.S. Cl. ..... 53/118; 53/139.5; 53/157; 53/581; 53/573

[58] Field of Search ..... 53/116, 117, 118, 119, 53/135.1, 135.2, 139.5, 415, 430, 211, 214, 389.1, 389.2, 389.3, 581, 587, 593, 157

[56] References Cited

U.S. PATENT DOCUMENTS

| | | | |
|---|---|---|---|
| 1,784,366 | 12/1930 | Littlefield | 53/430 X |
| 2,213,109 | 8/1940 | Spievak | 53/119 |
| 3,106,809 | 10/1963 | Forthmann | 53/116 |
| 3,543,476 | 12/1970 | Jaroff et al. | 53/157 X |
| 3,621,748 | 11/1971 | Felstehausen | 53/389.3 X |
| 3,694,998 | 10/1972 | Brinkley et al. | 53/593 X |
| 3,942,637 | 3/1976 | Glennie | 206/389 |
| 3,984,241 | 10/1976 | Schrempp et al. | 96/1 R |
| 4,162,009 | 7/1979 | Schouten | 206/389 |
| 4,219,272 | 8/1980 | Brückel et al. | 355/16 |
| 4,416,532 | 11/1983 | Rosati | 355/3 BE |
| 4,550,547 | 11/1985 | Wagner | 53/118 X |
| 4,583,348 | 4/1986 | Treiber et al. | 53/389.3 X |
| 4,707,704 | 11/1987 | Allen et al. | 346/24 |
| 4,912,510 | 3/1990 | Ogura et al. | 355/212 |
| 4,926,216 | 5/1990 | Hashimoto et al. | 355/212 |
| 5,144,787 | 9/1992 | Whitby et al. | 53/389.3 X |

FOREIGN PATENT DOCUMENTS

| | | | |
|---|---|---|---|
| 279016 | 11/1989 | Japan | 53/593 |

*Primary Examiner*—John Sipos
*Assistant Examiner*—Linda B. Johnson
*Attorney, Agent, or Firm*—Gary B. Cohen

[57] ABSTRACT

An apparatus is provided for disposing a sheet adjacent a flexible member. The apparatus comprises a mechanism for transporting the sheet to a loading position and a mechanism, located adjacent the loading position, for receiving and holding the sheet. The receiving and holding mechanism is capable of moving the sheet into juxtaposition with a surface of the flexible member so that the sheet contacts the surface of the flexible member upon being released by the receiving and holding mechanism. The apparatus further comprises a mechanism for wrapping the flexible member about itself with the sheet interposed between opposed surfaces of the flexible member.

12 Claims, 15 Drawing Sheets

APPARATUS FOR HANDLING A SHEET OF SEPARATOR MATERIAL

CROSS REFERENCE TO RELATED APPLICATIONS

The present application is a file wrapper continuation of U.S. patent application Ser. No. 07/724,307, filed Jul. 1, 1991 now abandoned.

BACKGROUND AND MATERIAL DISCLOSURE STATEMENT

1. Field of the Invention

The present invention relates generally to a technique for handling a sheet, and more specifically to an apparatus and method for disposing the sheet adjacent a surface of a flexible member and wrapping the flexible member about itself with the sheet interposed between opposed surfaces of the flexible member.

2. Description of the Prior Art

In the art of electrophotography an electrophotographic plate comprising a photoconductive insulating layer on a conductive layer is imaged by first uniformly electrostatically charging the imaging surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated area. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

The electrophotographic plate may be in the form of a flexible photoreceptor belt. These flexible belts include a substrate and a sensitive layer, the sensitive layer including an electrically conductive surface and at least one photoconductive layer. A common flexible photoreceptor belt comprises a substrate, a conductive layer, an optional hole blocking layer, an optional adhesive layer, a charge generating layer, a charge transport layer and, in some embodiments, an anti-curl backing layer.

These photoreceptor belts are usually thin and flimsy. Any considerable amount of handling of the belt, through, for example, shipping, can result in damage to the sensitive layer. Scratches, dents and other forms of damage to the sensitive layer, resulting from handling, can lead to degradation in image quality in printed material produced by the printing machine. Additionally, handling of the belt is made more difficult when the belt is in an unraveled state.

A technique for wrapping an elongate flexible loop with a sheet of protective paper is discussed in U.S. Pat. No. 5,163,265 to Darcy et al., the relevant portions of which are incorporated herein by reference. As indicated in the Wrapping Application, an elongate flexible loop or photoreceptor belt is packaged by wrapping it tightly about itself. Under normal circumstances, with many types of belts, the tight packaging is desirable; however, at least one situation can arise in which the tight wrapping can be quite undesirable. In particular, due to their relatively low thermal coefficient of expansion, belts used on the Xerox Copier 1065 exposed to temperatures in excess of ambient levels, tend to expand readily. When one of these belts is wrapped tightly, and subsequently heated, it has "nowhere to go", so that shear forces between belt substrate portions can increase beyond manageable levels. The inability to compensate for these unmanageable levels of shear forces can cause distortion throughout the sensitive layer of the belt in the form of "dimpling." Use of a dimpled belt will inevitably result in unacceptable copy quality. Hence it would be desirable to provide a technique that would minimize shear forces under the above-mentioned conditions and thereby eliminate dimpling.

SUMMARY OF THE INVENTION

In accordance with the present invention, an improved apparatus is provided for disposing a sheet adjacent a flexible member. The apparatus comprises means for transporting the sheet to a loading position and means, located adjacent the loading position, for receiving and holding the sheet. The receiving and holding means are capable of moving the sheet into juxtaposition with a surface of the flexible member so that the sheet contacts the surface of the flexible member upon being released by the receiving and holding means. The apparatus further comprises means for wrapping the flexible member about itself with the sheet interposed between opposed surfaces of the flexible member.

In one aspect of the invention, the flexible member can be an elongate flexible loop, and the wrapping means can include means for supporting internal portions of the elongate flexible loop. Additionally, the apparatus preferably comprises means for supplying a length of separator material, the supplying means being adapted to deliver a free edge of the separator material to a location adjacent the transport means. The transport means can include a carriage for transporting the length of separator material in a direction substantially parallel to a long axis of the flexible member. Finally, the apparatus can include means for driving automatically the receiving and holding means from a location spaced from the flexible member to a location adjacent the flexible member.

In another aspect of the invention, the apparatus further comprises means, positioned in the path of conveyance of the receiving and holding means, for applying a charge to the sheet as it is passed therethrough. In one example, the charge-applying means is a corotron.

Numerous features will be appreciated by those skilled in the art.

One feature of the present invention is that it minimizes labor costs. That is, the apparatus is adapted to quickly perform steps that would normally occupy a human user for a considerable time interval. Consequently, the apparatus frees up the user to perform tasks other than manual paper handling tasks.

Another feature of the present invention is that each sheet of separator material can be formed with the greatest degree of precision and efficiency. In particular, sheets of exact specification can be cut automatically from a supply of separator paper as many times as desired. Moreover, in one embodiment the sheet is transported to a location adjacent the flexible member, and cut to specification, in less than thirty seconds.

Another feature of the present invention is that it optimizes the process of entraining the sheet of separator material with the flexible member. For example, as the sheet is moved toward the flexible member, the sheet can be pulled through the charge-applying means so that the sheet, which accordingly clings to the surface of the flexible member, can be more uniformly entrained with the flexible member.

These and other aspects of the invention will become apparent from the following description, the description being used to illustrate a preferred embodiment of the invention when read in conjunction with the accompanying drawings.

DESCRIPTION OF A PREFERRED EMBODIMENT OF THE INVENTION

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
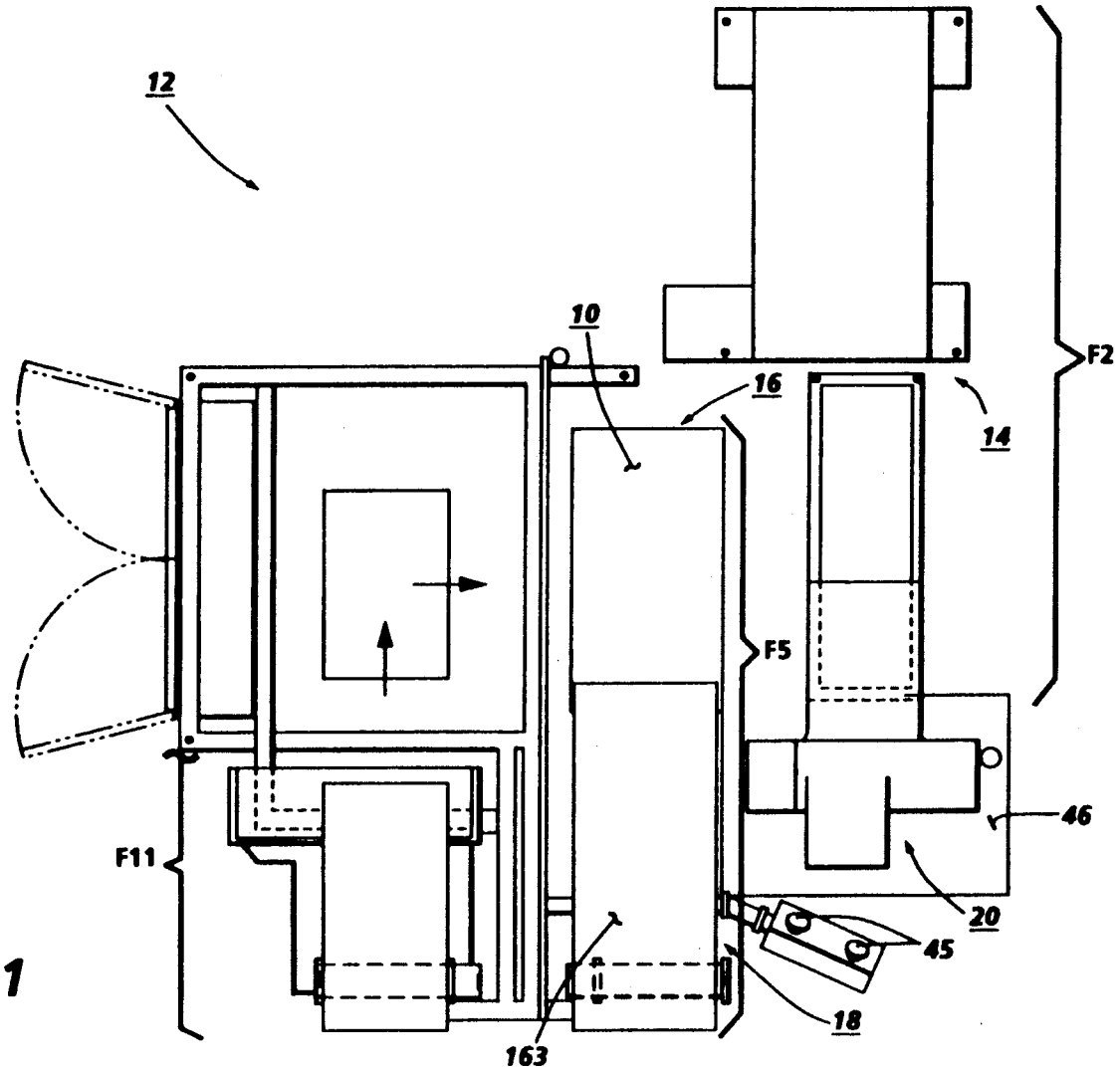
FIG. 1 is a schematic view of a floor plan of an apparatus for wrapping protective paper about a sensitive surface of a flexible image loop.

Referring to FIG. 1, a floor-plan of an apparatus for automatically wrapping protective paper about a flexible image loop 10 is designated by the numeral 12. In the illustrated embodiment, the flexible image loop is a photoreceptor belt having a length and a width. The apparatus 12 includes a core transport assembly 14, a wrapping assembly 16 and a protective paper feed assembly 18.

Figure 2:
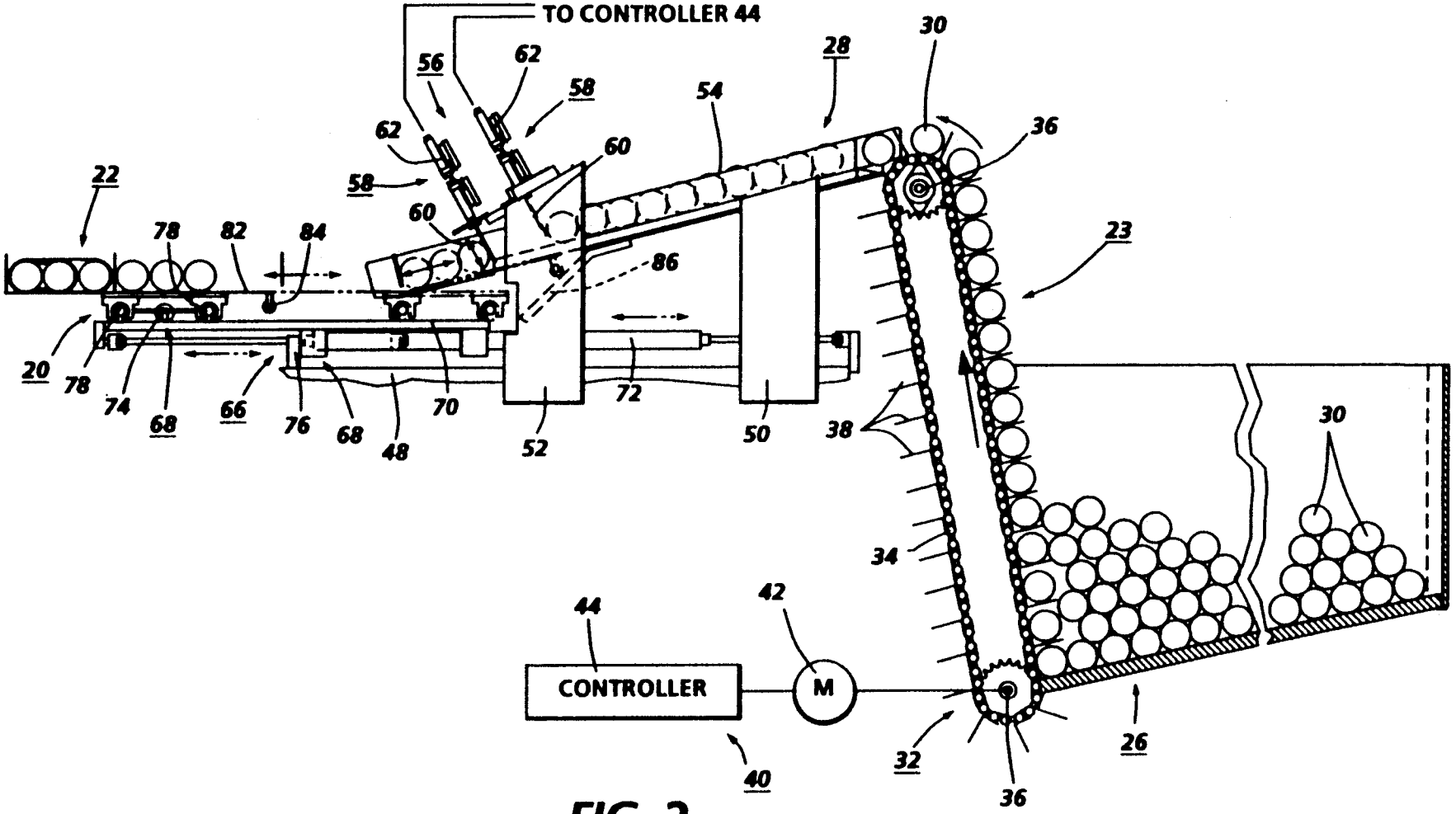
FIG. 2 is a schematic, elevational view of an assembly for selectively loading cores onto a transport device, and transporting the cores to a belt wrapping assembly.

Referring to FIG. 2, the core transport assembly 14 is illustrated in further detail. The transport assembly 14 includes a movable cart 20, the cart having a receiving bin 22 mounted thereto and being in communication with a loading station 23. The loading station 23 includes a hopper 26 and a chute 28, the hopper 26 being adapted to store a plurality of cores or cardboard tubes 30. The cores 30 are transported to the chute 28 by way of a conveyor mechanism 32. The conveyor mechanism 32 comprises an endless chain 34 wrapped around sprockets 36, the chain 34 having spaced-apart paddle-wheels 38 affixed thereto. The sprockets 36 are driven by a conventional motor arrangement 40.

The motor of motor arrangement 40, as well as all motors referred to hereinafter, are controlled by way of a conventional drive mechanism 42 interfaced with a programmable controller or a microprocessor 44, such microprocessor 44 being obtainable from Motorola Corporation (via the 68000 series). As illustrated in FIG. 1, the controller 44 includes palm buttons 45 for starting and stopping the apparatus 12. Additionally, a safety mat 46, which serves as a "deadman's switch" for the apparatus 12 is positioned next to the palm buttons 45. When the operator is standing on the mat 46, the apparatus 12 is maintained in an inoperative state.

Figure 3:
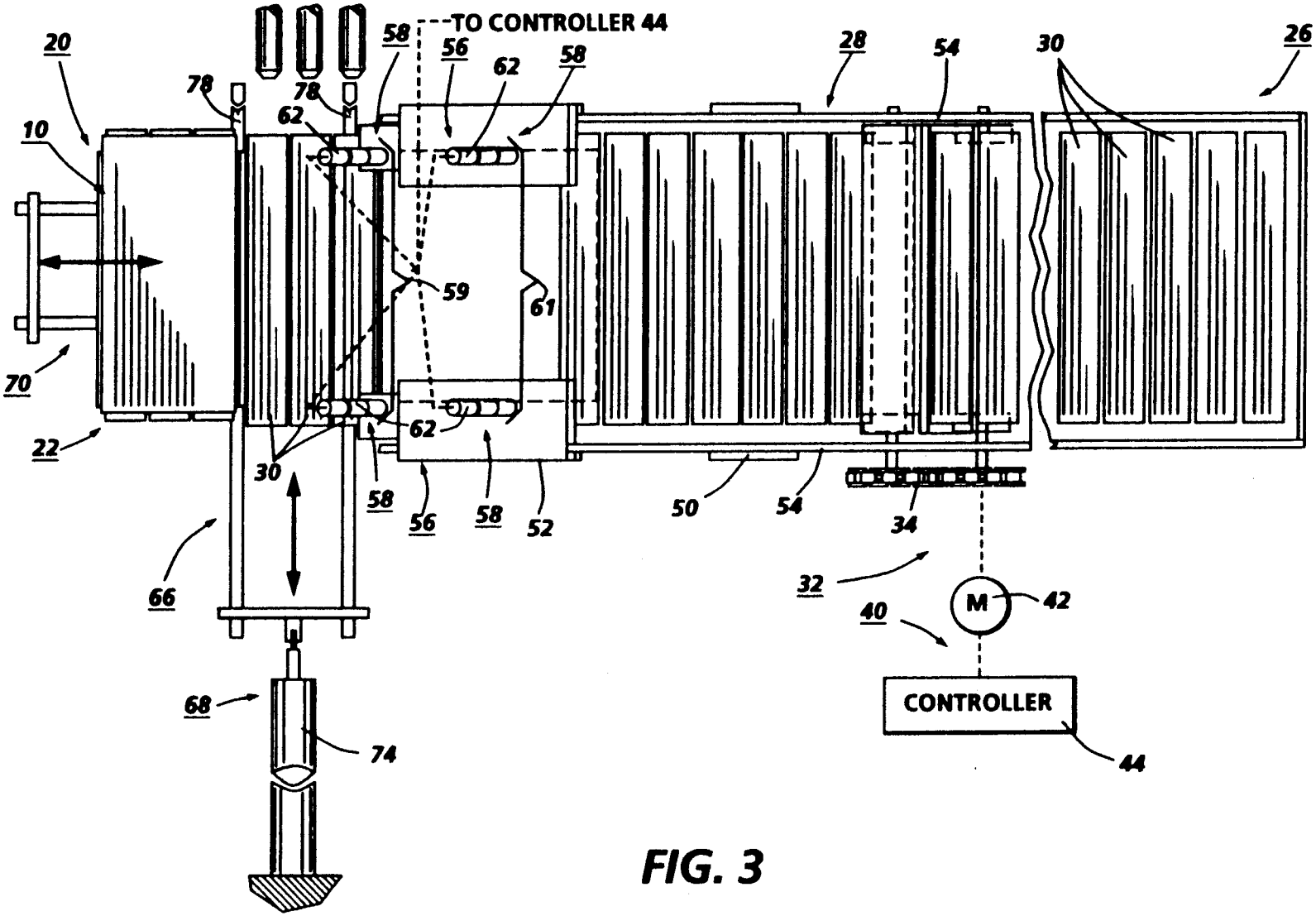
FIG. 3 is a schematic, overhead plan view of the assemblies illustrated in FIG. 2.

As illustrated in FIGS. 2 and 3, the paddle-wheels 38 are capable of raising the cores 30 out of the hopper 26 to the chute 28. The chute 28 is supported by a frame 48 having supports 50, 52, while the chute 28 is inclined so that cores 30 can roll freely down to the cart 20. Referring specifically to FIG. 3, the chute 28 has ledges 54 for retaining the cores 30 therein, and the chute 28 is adjustable laterally to accommodate for cores 30 of varying lengths. As the cores 30 roll down the chute 28, they are selectively retained by a capturing mechanism 56. In one example, the capturing mechanism 56 comprises two pairs of submechanisms 58, each of which submechanism 58 is operatively mounted to the support 52. The front pair of submechanisms 58 will hereinafter be referred to as core stop 59, while the rear pair of submechanisms 58 will be referred to as core separator 61. Each submechanism 58 has a retractable needle 60 connected to an air cylinder 62. The spacing between the core stop 59 and the core separator 61 is such that a predetermined number of cores 30 can be retained between the needles 60 when the needles 60 are in the extended position. The needles 60 are extended and retracted by use of the air cylinders 62.

Figure 4:
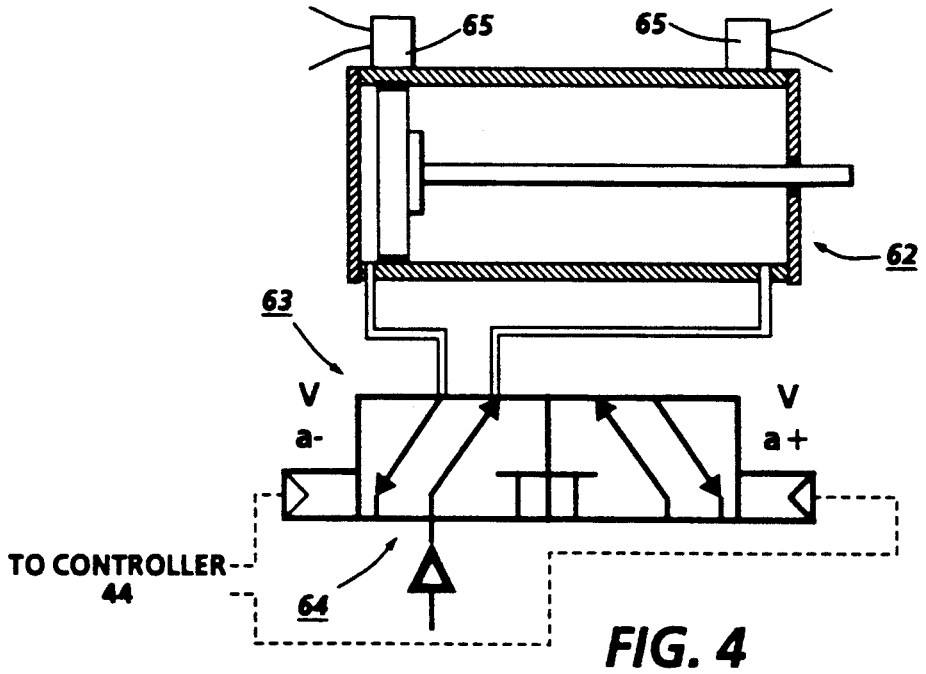
FIG. 4 is a schematic, sectional view of an arrangement used to drive a typical air cylinder used in the apparatus.

Referring specifically to FIG. 4, an arrangement employed to drive air cylinder 62, as well as most of the air cylinders used throughout the apparatus 12, is designated by the numeral 63. The arrangement 63 includes a supply of compressed air (not shown), a bidirectional valve 64 and the microprocessor 44. In the preferred embodiment, the valve 64, which can be obtained from Norgren Corporation, shifts air direction according to whether the valve 64 is positively or negatively biased by the microprocessor 44. Additionally, when the piston of cylinder 62 is magnetic, the extent of movement of the air cylinder 62 can be sensed by use of conventional limit switches 65.

The cart 20 is operatively associated with a shuttling mechanism 66 (FIGS. 2 and 3), the shuttling mechanism 66 including a drive mechanism 68 and a transport table 70. The drive mechanism 68 comprises a dual-position air cylinder 72 for driving the table 70 in a first direction, and a cylinder 74 for driving the cart 20 in a second direction, the second direction being transverse to the first direction. As best illustrated in FIG. 2, a dual position cylinder comprises two cylinders in series, both of which function cooperatively to position the cart 20 in two distinct positions, namely a core-loading position and an unloading position. The dual-position air cylinder 72 is operatively mounted to the frame 48, while the second cylinder 74 is interconnected with the table 70. In particular, the transport table 70 is supported by portions of the dual-position air cylinder 72, and the cart 20 is slideably mounted on the transport table 70 by way of a pair of guide rails 78 formed thereon. Accordingly, the cart 20 can be driven, along the second direction, from one end of the table to the other by use of the second cylinder 74.

In one example, a platform 82 (FIG. 2), having a raised edge, is positioned on the cart 20 adjacent the receiving bin 22. A cam follower 84 is mounted on the underside of the platform 82, the cam follower 84 being adapted to cooperate with a cam 86 mounted on the underside of the chute 28. As best illustrated in FIG. 2, when an edge of the cart is brought proximate to the support 52, the cam follower 84 rides along the cam 86 so that the platform 82 directly underlies the exit edge of the chute 28. As the cart 20 is moved away from the chute 28, the platform 82, having a preselected number of the cores 30 disposed thereon, pivots down onto the cart 20 so that the raised edge of the platform 82 abuts a raised edge of the receiving bin 22.

Figure 5:
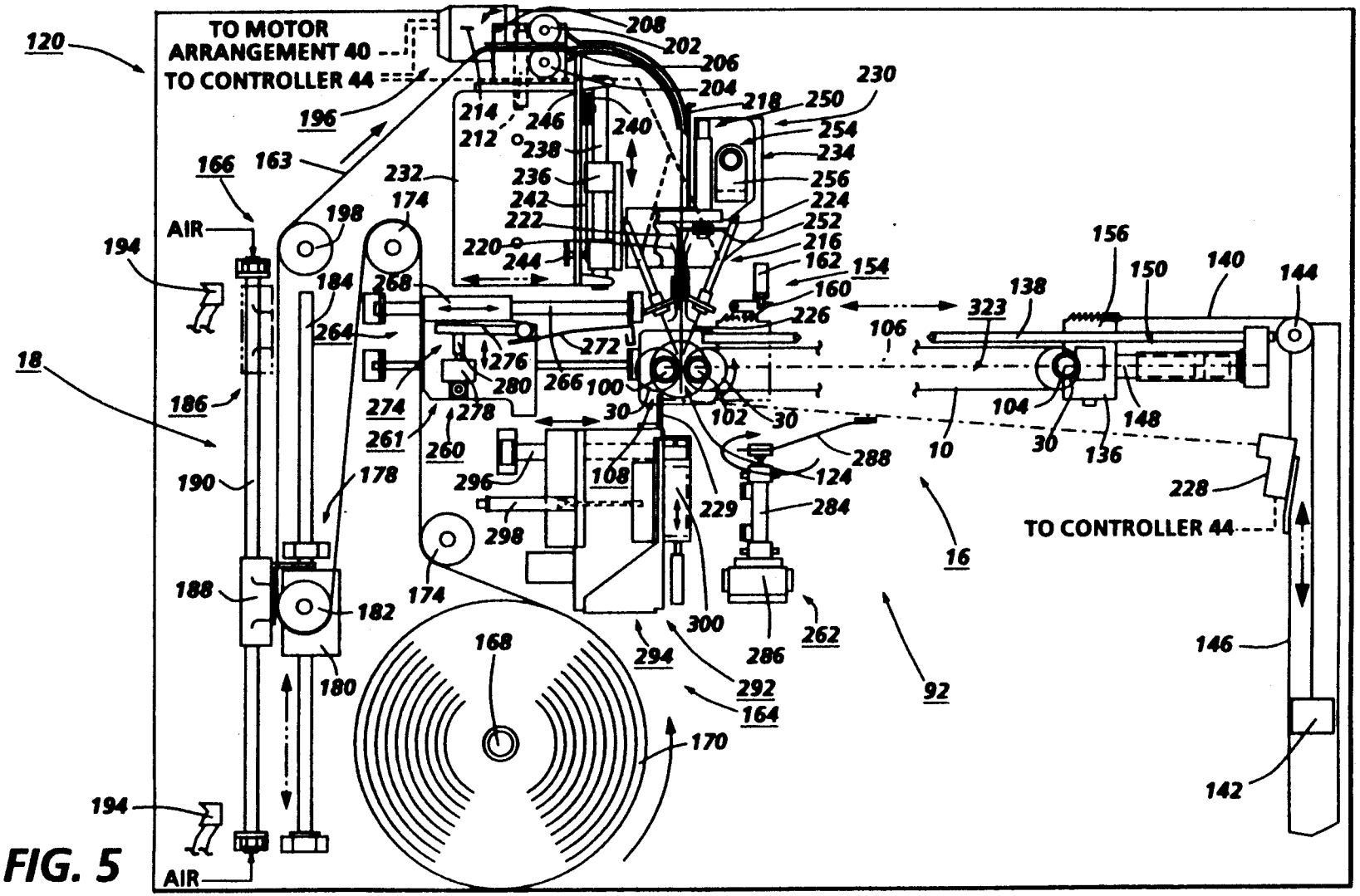
FIG. 5 is a schematic, elevational view of a protective paper feeding assembly coupled with the belt wrapping assembly.
Figure 6:
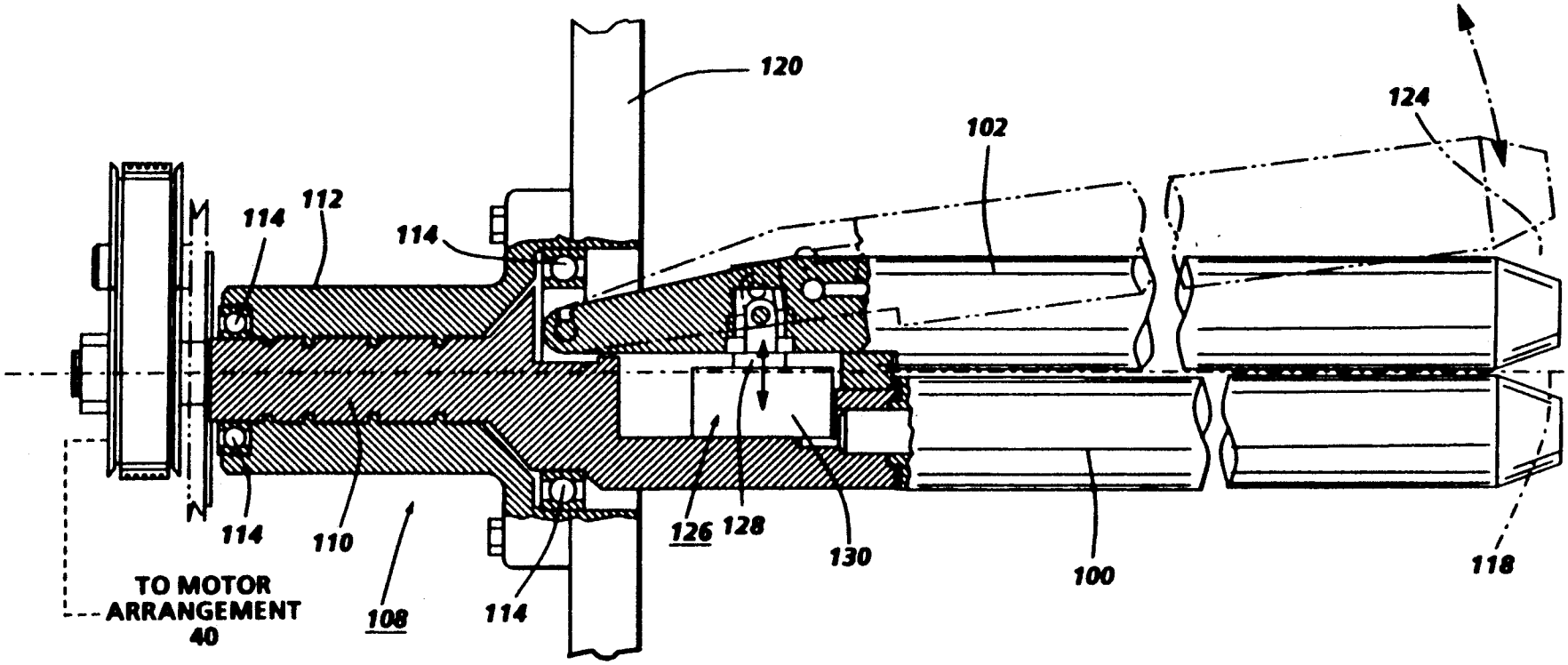
FIG. 6 is a schematic, elevational view of two fingers operatively mounted to a Turret.

Referring to FIGS. 3 and 5, three cores 30 are shuttled at a time to a wrapping station designated by the numeral 92. The wrapping station 92 comprises the wrapping assembly 16 and the protective paper feeding assembly 18. The wrapping assembly 16 includes a first finger 100, a second finger 102 and a third finger 104, each of which fingers 100, 102, and 104 is disposed along a common plane 106. Referring specifically to FIG. 6, the fingers 100, 102 are operatively mounted to a turret mechanism 108, the turret mechanism 108 including a shaft 110 rotatably mounted in a collar 112 with bearings 114. The shaft 110 is operatively connected to the motor arrangement 40 so that the fingers 100 and 102 can be rotated simultaneously about an axis 118 in response to the rotation of the shaft 110. Additionally, the turret mechanism 108 is mounted to a support plate 120 by way of the collar 112 and fasteners 122. In one example, the support plate 120 is a one inch thick jig plate.

Referring still to FIG. 6, the second finger 102 is pivotally mounted to the turret mechanism 108 so that the second finger 102 can be selectively displaced relative to the first finger 100 to form a gap 124. Displacement is achieved automatically by use of a finger displacement mechanism 126. The finger displacement mechanism 126 includes a movable displacement member 128, the movable displacement member 128 being responsive to the displacement of a "pancake" air cylinder 130.

Referring again to FIG. 5, the third finger 104 is connected to a block 136, the block 136 being slideable mounted on a guide 138. The follower support 138 is operatively connected to the support plate 120. The slideable block 136 is urged away from the fingers 100 and 102 by an arrangement including a cable 140 and a counterweight 142. One end of the cable 140 is integrally connected to the slideable block 136 and the other end to the counterweight 142. The cable rides over a pulley 144 and the counterweight 142 is displaced within a channel 146. A plunger 148 is mounted to and extends from the block 136, so that the plunger 148 interacts cooperatively with an adjustable deceleration damper 150 to set the finger 104 at an extended position with respect to the fingers 100 and 102.

The third finger can be positioned proximate to the second finger 102 by employment of the finger biasing mechanism 154. The biasing mechanism 154 includes a ratchet member 156 defining a set of integral teeth. The teeth cooperate with a latch 160, the movement of the latch 160 being controlled selectively by a solenoid 162. In a first state the solenoid 162 allows the latch 160 to drop into the teeth to hold the finger 104 proximate to the second finger 102, while in a second state, the latch 160 is released so that the third finger 104 is urged, by the sliding block 136, toward the deceleration damper 150. When the plunger 148 engages the damper 150, the third finger 104 is disposed in the extended position. As can be appreciated by reference to FIG. 5, if the belt 10 is positioned about the fingers 102 and 104, the belt 10 will be disposed in an extended position when the third finger 104 is disposed correspondingly in the extended position.

In the preferred embodiment, protective paper is fed into the gap 124 by the protective paper feed assembly 18. The feeding assembly 18 includes a protective paper supply 164 and a protective paper transport mechanism 166. The paper supply 164 includes a shaft 168, the shaft 168 being mounted to the support plate 120 and adapted to support a supply or roll 170 of protective paper. In one example, the protective paper is black photo wrap and has a width at least as great as the width of the photoreceptive belt 10 to be wrapped. The transport mechanism 166 includes idler or tension rollers 174 that serve to guide the protective paper to a "dancer" roller mechanism 178. Essentially, the mechanism 178 allows substantial lengths of protective paper to be pulled off of the roll 170 so that inertia of the roll 170 will not impair the wrapping process.

The dancer roller mechanism 178 includes a carriage 180 having a roller 182 mounted thereto. The carriage 180 is positioned on a guide 184, and is responsive to a "rodless cylinder" arrangement 186 manufactured by Festo Corporation of Hauppauge, N.Y. The rodless cylinder arrangement 186 comprises a saddle 188, which saddle 188 is coupled with the carriage 180. The saddle 188 is slideable mounted on a rod 190, and moves in response to an air-driven magnetic piston (not shown) disposed in the rod 190. In the illustrated embodiment the extent of movement of the saddle 188 can be sensed by way of limit switches 194. A description of the rodless cylinder arrangement 186 can be found in U.S. Pat. No. 4,878,985, the disclosure of which is incorporated herein by reference. As will be appreciated by those skilled in the art, any suitable drive mechanism capable of reciprocating the carriage 180 may be used in place of the magnetic reciprocating drive system 186. Moreover, it will also be appreciated that the rodless cylinder arrangement 186 is very similar, in concept, to the drive arrangement 63.

With continuing reference to FIG. 5, the protective paper is pulled through the dancer mechanism 178 by way a nip roller mechanism 196. An idler 198 aids in guiding the protective paper to the mechanism 196. The mechanism 196 includes a nip roller 202 in selective contact with a drive roller 204 to define a nip 206. The drive roller 204 is driven by the motor arrangement 40.

The nip roller 202 is operatively connected to a pivotable arm 208, the pivotable arm 208 being in contact with a pancake cylinder 212. When the cylinder 212 is energized, the nip roller 202 is displaced relative to the drive roller 204 so that the nip 206 is disengaged. An encoder 214, of any suitable construction, is operatively associated with the nip roller mechanism 196, and is positioned adjacent the path of the protective paper. As is known, the encoder 214, in conjunction with the controller 44, is capable of determining the length of protective paper that passes by the mechanism 196 in a predetermined time period. Accordingly, under ideal operation, the controller 44 is informed as to the moment that the leading edge of the protective paper passes through the gap 124.

The protective paper is directed from the exit of mechanism 196, to the gap 124, by way a paper guide network 216, the guide network 216 including an adjustable guide 218 as well as a fixed set of baffles 220 and a movable set of baffles 222. The leading edge of the protective paper is further directed into the gap 124 by means of guide cylinders 224. Each of guide cylinders 224 has a guide needle 226, the displacement of which is effected by the controller 44.

While, under ideal operating conditions, the encoder 214 can be employed to detect when the leading edge of the protective paper has passed through the gap 124, the encoder 214 cannot accurately accomplish this detection on a regular basis. For example, even when the protective paper "strays" from the network 214, the encoder 214 will indicate that the leading edge is through the gap 124 since the encoder 214 merely detects the length of protective paper that has passed by. To verify information from the encoder 214, a secondary detection system, namely a photo-detecting arrangement, is provided.

As illustrated in FIG. 5, a light transmitting/photodetecting unit 228, which communicates with the controller 44, is mounted on the support plate 120 at a location spaced from the gap 124. A reflector 229 is positioned proximate to the gap 124 so that light transmitted from the unit 228 can be reflected back to a photoreceptive device (not shown) disposed in the unit 228. When the light beam is broken by the leading edge of the protective paper passing through the gap 124, the corresponding signal can be transmitted to the controller 44, via the transmitting/photo-detecting unit 228, to indicate the presence of the protective paper.

In one example, an upper portion of the movable baffles 222 is mounted to a cutting mechanism 230. Both of the nip roller mechanism 196 and the cutting mechanism 230 are mounted to the support plate 120 by way of a back plate 232. In particular, the cutting mechanism 230 includes a frame 234 having a slide-piece 236, while the back plate 232 has a guide 238 for receiving the slide-piece 236. The slide-piece 236, and hence the frame 234, can be displaced along the guide 238 by an arrangement including a pulley 240 and a cable 242. The slide-piece 236 responds to the rotation of the pulley 240, and the slide-piece 236 is positioned selectively by a manual clamp 244. The manual clamp 244 is slideable mounted in a slot (not shown), the slot being defined in a side wall 246 of the back plate 232.

The cutting mechanism 230 further includes a cutting device 250 having a rotary cutting blade 252. As illustrated in FIG. 5, the blade 252 is disposed transverse to the long axis of the protective paper. The cutting device 250 is operatively mounted to a drive mechanism 254, and the drive mechanism 254 is mounted to the frame 234. The drive mechanism 254 can be any suitable drive, such as the rodless cylinder arrangement 186. As with rodless cylinder arrangement 186, the drive mechanism 254 could include a movable saddle 256, the displacement of which could be constrained by limit switches (not shown). In its home position, the cutting device 250 is retracted so that the paper is spaced from the rotary cutting blade 252. When cutting of the protective paper is desired, the saddle 256 is displaced from the home position so that the cutting blade 252 is driven through a path that permits the cutting device 250 to cut a sheet of protective paper. Since the frame 234 is adjustable, the cutting mechanism 230 is adapted to cut sheets of varying length.

A tailing assembly, the significance of which will be described in further detail below, comprises a half-tailer 260 and a full-tailer 262. The half-tailer 260 includes a carriage 261 slideable mounted on a drive mechanism 264, the drive mechanism 264 being operatively mounted to the support plate 120. The drive mechanism 264 can comprise any suitable mechanism, such as a rodless cylinder arrangement. In the illustrated embodiment, the carriage 261 is driven along a guide 266 by a rodless cylinder device 268. The half-tailer 260 further includes a keeper 272, which keeper 272 can be displaced pivotally for height adjustment by a keeper displacement mechanism 274. The mechanism 274 comprises an arm 276, the arm 276 being pivotally connected to a pancake air cylinder 278 by way of a link 280. The extent to which the arm 276 is displaced can be sensed by way of the limit switches (not shown). When the cylinder 278 is activated, the arm 276 is pivoted to raise the keeper 272 by a predetermined distance.

The full-tailer 262, which includes an air cylinder 284 operatively connected to an air rotary cylinder 286, is mounted operatively to the support plate 120. The full-tailer 262 also includes a wiper 288, which wiper 288 rotates in response to the rotation of the rotary cylinder 286. The air cylinder 284 is capable of raising the wiper 288 to a location adjacent the cores 30, so that the wiper 288 can be positioned proximate to preselected portions of the cores 30 when the wiper 288 is rotated through a predetermined arc.

Figure 7:
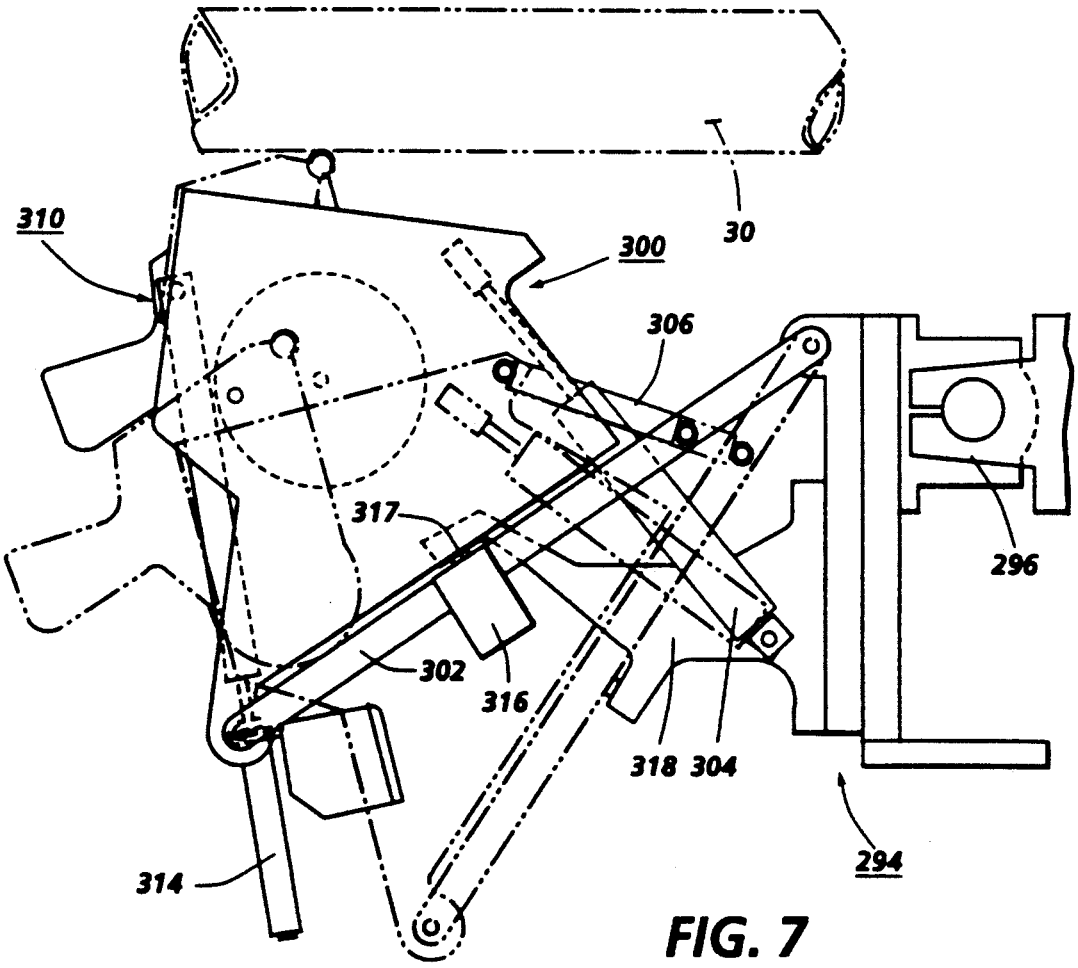
FIG. 7 is a side view of a taping assembly schematically illustrated in FIG. 5.

Referring to FIGS. 5 and 7, a taping assembly is designated by the numeral 292. The taping assembly 292 includes a carriage 294 (FIG. 5), which carriage 294 can be displaced along a guide 296. The carriage 294 is reciprocated, relative to a home position, by an air cylinder 298. In the preferred embodiment, the guide 296 and the air cylinder 298 are mounted to the support plate 120. A taper 300 (FIG. 7) is pivotally mounted to the carriage 294 with a swivel arm 302, and the taper 300 is driven upward by an air cylinder 304. In one example, the taper 300 is a conventional label "gun" of the type used in supermarkets for applying labels to inventory. As the taper 300 is driven upward by the air cylinder 304, a spring or air cylinder 306, interposed between the taper 300 and the swivel arm 302, is activated so that the taper 300 is directed through a semicircular path. This is essentially the same path or wiping motion that would be employed in placing labels on supermarket inventory.

Referring specifically to FIG. 7, the taper 300 includes a trigger 310 which, upon activation, allows tape to be dispensed from a roll of conventional tape (not shown) disposed within the taper 300. The trigger 310 is "pulled" by an air cylinder 314, which air cylinder 314 communicates selectively with an air source (not shown) by way of a valve 316. In particular, the valve 316 has an actuating button 317, and the valve 316 is mounted to the swivel arm 302. Additionally, a bracket 318 mounted to the carriage 294 is disposed in the semicircular path of the swivel arm 302. As the taper 300 is reciprocated through the semicircular path, the button 317 is depressed by an end portion of the bracket 318 so that the valve 316 is opened and the trigger 310 is pulled.

Referring again to FIGS. 2-3, the preferred form of operation for core loading/core unloading is explained in further detail. Initially, a plurality of cores 30 are loaded into the hopper 26 and a stream of cores 30 is delivered to the top of chute 28 by the conveyor mechanism 32. In their home positions, the needles 60 of the core stop 59 are extended to retain the cores 30, while the needles 60 of the core separator 61 are retracted. To load a preselected number of cores 30, preferably three of cores 30, onto platform 82, the cart 20 is moved proximate the core stop 59 and the air cylinder 72 is then retracted. By use of the controller 44, the needles 60 of the core separator 61 are extended, and the needles 60 of the core stop 59 are retracted, so that three of cores 30 fall onto the platform 82.

Once the cores 30 are on the platform 82, the cart 20 is shuttled over to the fingers 100, 102 and 104 by extending the cylinders 72, 74. In particular, the first cylinder 72 is capable of aligning the cores 30 with the fingers 100, 102 and 104, while the second cylinder 74 is capable of positioning cores 30 on the fingers 100, 102 and 104. After positioning the cores 30 on the fingers 100, 102 and 104, the cart 20 is retracted so that the positioned cores 30 have clearance in which to rotate.

Figure 8A:
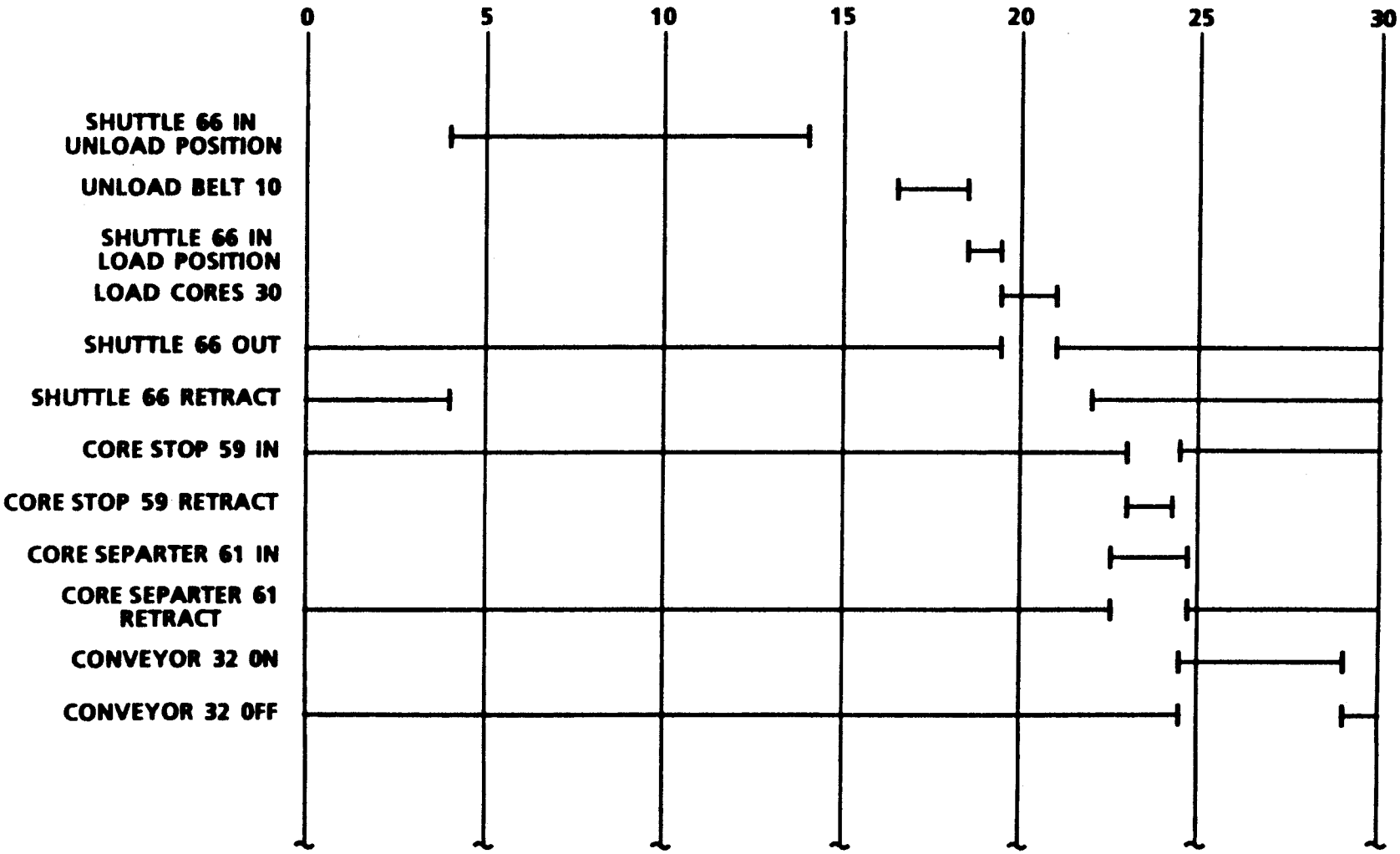
FIGS. 8A-8C are timing diagrams depicting time intervals taken to perform major steps in the belt wrapping process.

Upon initially loading the cores 30 onto the cart 20, the core loading steps can be achieved in accordance with the sequence illustrated in FIG. 8A. For example, before loading three of cores 30 onto the respective fingers 100, 102 and 104, the receiving bin 22 is positioned adjacent the fingers 100, 102 and 104 in an unload position so that a wrapped belt, i.e. a finished product (FIG. 10B), can be unloaded from the wrapping assembly 16 into the bin 22. Upon unloading the finished product the three cores 30 are aligned with the fingers 100, 102 and 104 and the cores 30 are loaded thereon. The cart 20 is then retracted to the exit end of the chute 28 to retrieve three more cores 30, as described above.

Referring now to FIGS. 5-6, 8B and 9A-9E, the operation of the wrapping assembly 16 and the protective paper feed assembly 18 is explained in further detail. Initially, the protective paper is threaded manually through the dancer roller mechanism 178, the nip roller mechanism 196 and the paper guide network 216. The finger displacement mechanism 126 is actuated to form the gap 124, and the leading edge of the protective paper is positioned therein. Upon placing the belt 10 about the fingers 102 and 104, the gap 124 is closed and the solenoid 164 is actuated so that the belt 10 is urged into the extended position by the unlatched block 136. Additionally, the dancer roller mechanism 178 is actuated so that a length of protective paper is pulled down.

Figure 8B:
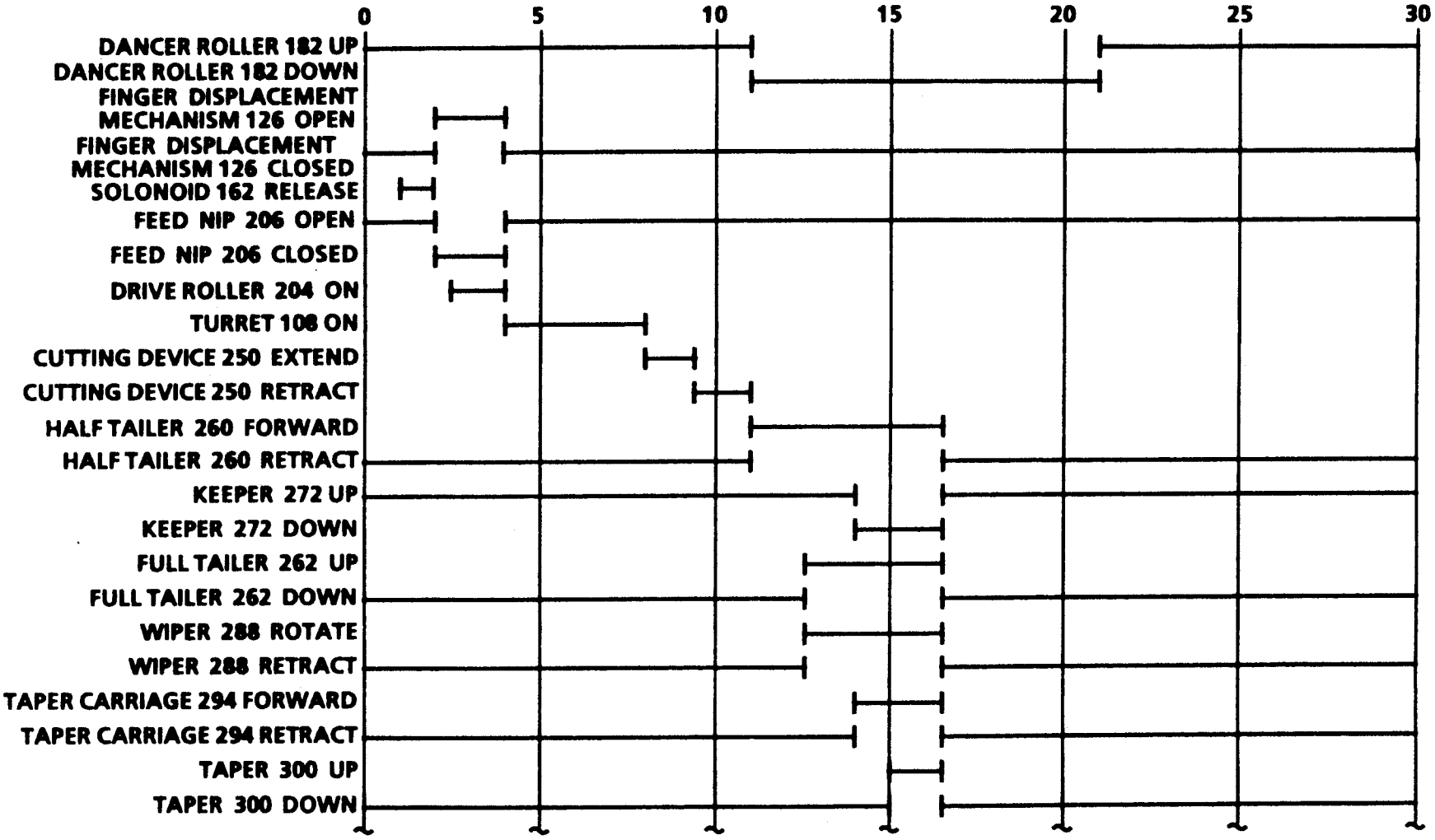

Referring specifically to FIG. 8B, an automatic belt wrapping process is shown. The process outlined in FIG. 8B presupposes that, prior to start up, i.e. "0" seconds on the time scale, the protective paper has already been threaded through the protective paper feed assembly 18, and pulled down by the dancer roller mechanism 178. Consequently, in the scheme of FIG. 8B the dancer roller 182 is not be pulled down until the protective paper has been driven automatically, by way of nip roller mechanism 196 to the gap 124, and a sheet of protective paper has been cut from the protective paper supply.

To wrap the belt 10, the nip 206 is opened (FIGS. 5 and 8B), the guide needles 226 are retracted, and the turret mechanism 108 is rotated about axis 118 in a counter-clockwise direction. Accordingly, the third finger 104 is "reeled in" and the protective paper is wrapped about a substantial potion of the photosensitive surface of the belt 10. When the third finger 104 is proximate the second finger 102 (FIG. 9A), rotation of the turret mechanism 108 is halted and a sheet of protective paper is formed by extending and retracting the cutting device 250 (FIG. 5) across a preselected portion of the protective paper supply.

A tail portion 318 of the protective paper (FIG. 9A) is formed as a result of the cutting step. Referring to both FIGS. 8B and 9B-9C, the carriage 261 of the half-tailer 260 extends from its home position, so that the keeper 272 "knocks down" the tail, and the keeper 272 descends to partially fold the tail over. Referring to both FIGS. 8B and 9D, as the half tailer 260 is extended, the full tailer 262 is moved up to a point just under a plane in which the fingers 100, 102 and 104 are disposed, and the wiper 288 is rotated so that the trailing edge of the sheet of protective paper is retained against a portion of the protective paper that has already been wrapped about the cores 30.

Figure 9A:
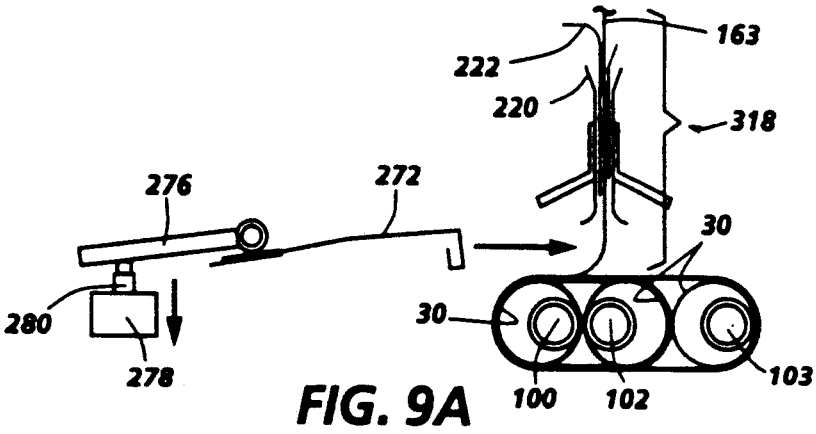
FIGS. 9A-9E are schematic, fragmentary, elevational views of the apparatus depicting the process employed to wrap a tail portion of a sheet of protective paper about three cores.
Figure 9B:
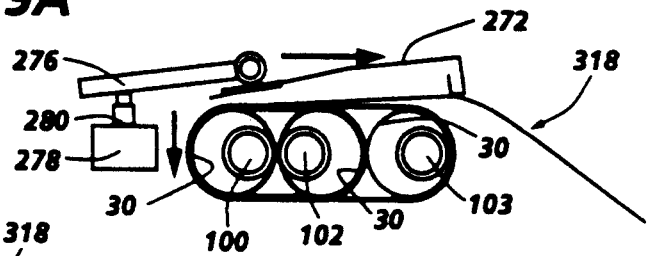
Figure 9C:
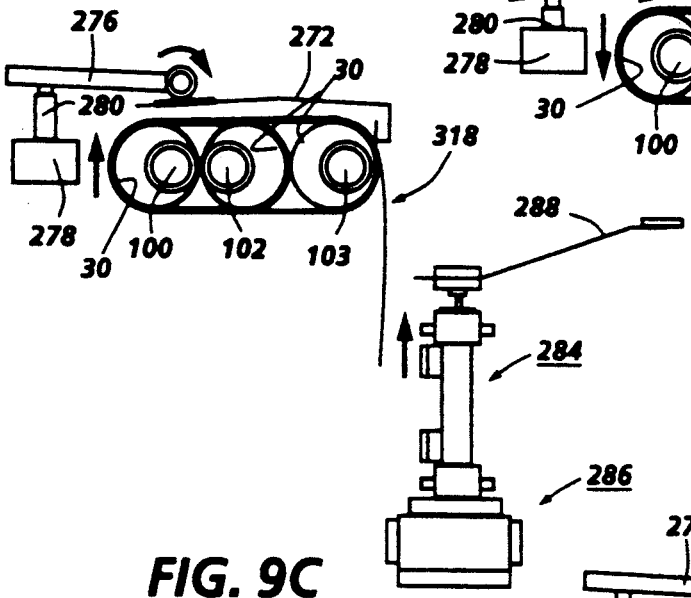
Figure 9D:
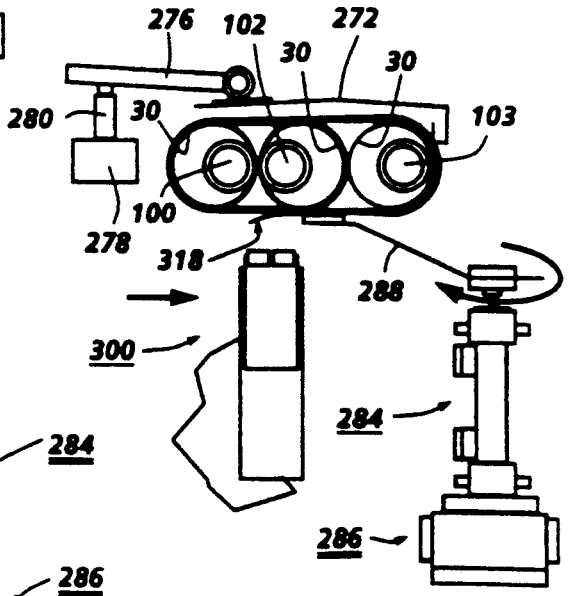
Figure 9E:
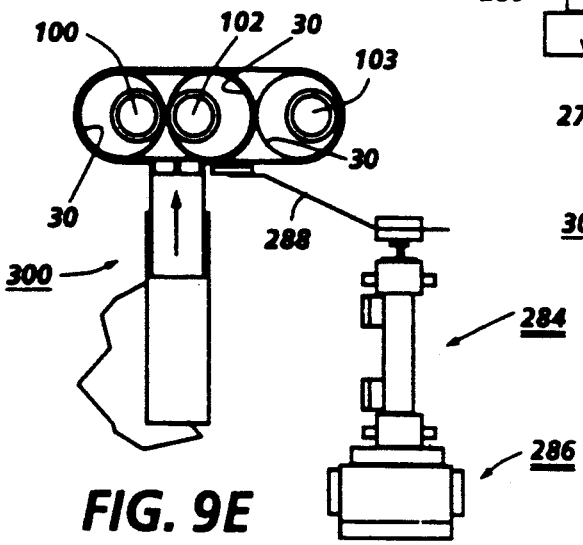
Figures 10A, 10B:
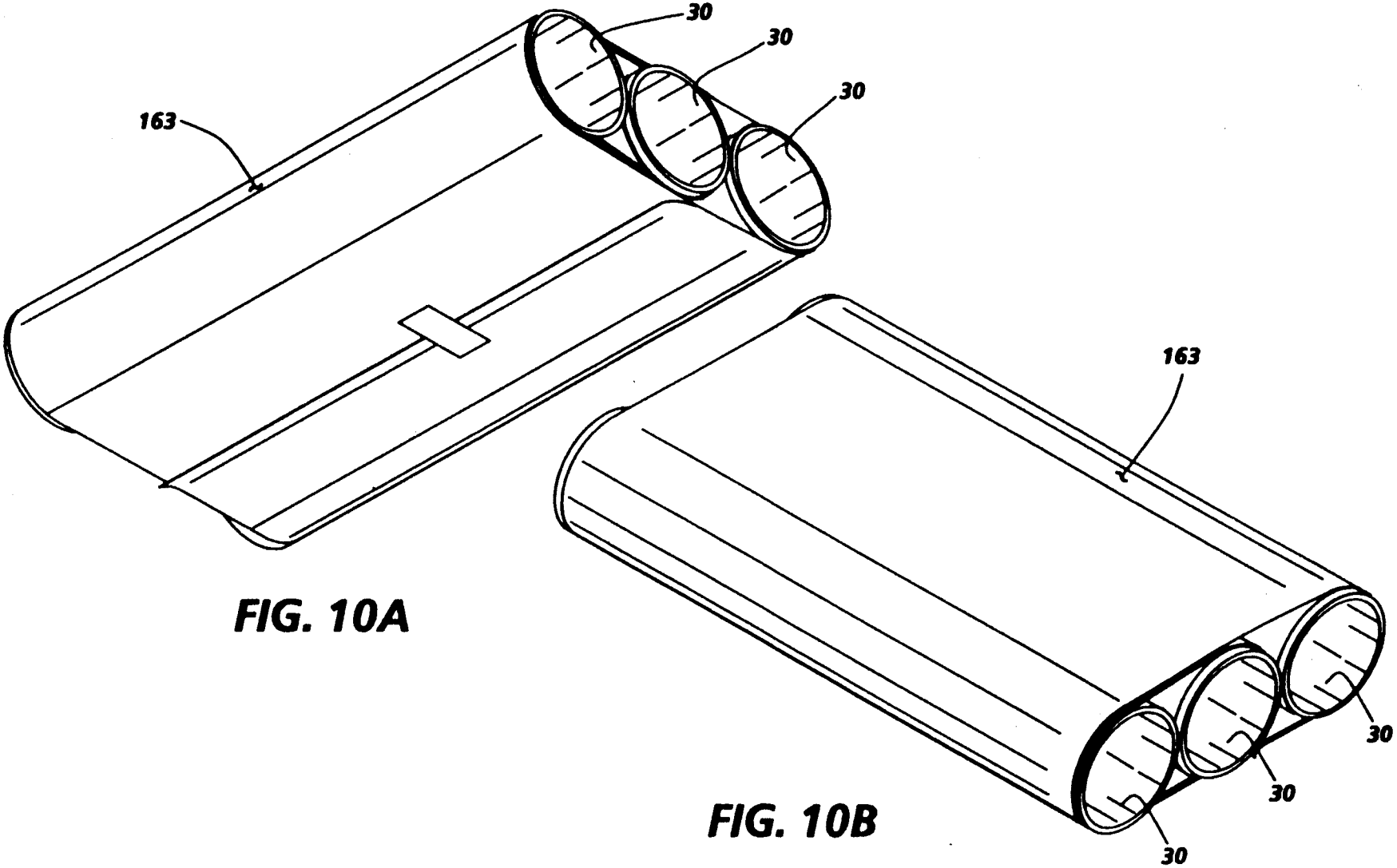
FIGS. 10A-10B are perspective views of a photoreceptive belt wrapped about the three cores by the apparatus.

Referring to FIGS. 7, 8B and 9E, shortly after the wiper 288 begins to rotate, the taping assembly carriage 294 is moved to a point under the cores 30 by air cylinder 298. Air cylinders 304 and 306 are activated in sequence so that the taper 300 is moved upward through a semicircular path. As the taper 300 wipes against the protective paper, the valve 316 is opened, and the trigger 310 is pulled accordingly by the air cylinder 314. As illustrated in FIG. 10A, a piece of tape is thereby applied to the finished product so that the trailing edge of the protective paper is secured against the protective paper already wrapped around the cores 30. As will be appreciated by those skilled in the art, other means besides a taper, such as a gluing device, could be used to secure the trailing edge. After the taping step is completed, the wrapped belt 10 (FIG. 10B) can be either manually or automatically unloaded, and deposited in receiving bin 22.

When wrapping certain photoreceptor belts, such as that photoreceptor belt adapted for use in the Xerox Copier 1065 copier, it is desirable to entrain a sheet of separator or tissue paper 320 with the belt 10 so that each point of the belt substrate is separated from any adjacent substrate point. It has been found that by entraining the sheet of tissue paper 320 with the belt 10, all portions of the belt substrate have the ability to "slip" relative to adjacent substrate portions of the belt 10 so that shear forces between the adjacent portions are minimized. Due to the ability of the belt 10 substrate to slip, the tendency of wrapped belt 10 to dimple, or otherwise distort when heated, is alleviated.

Figure 11:
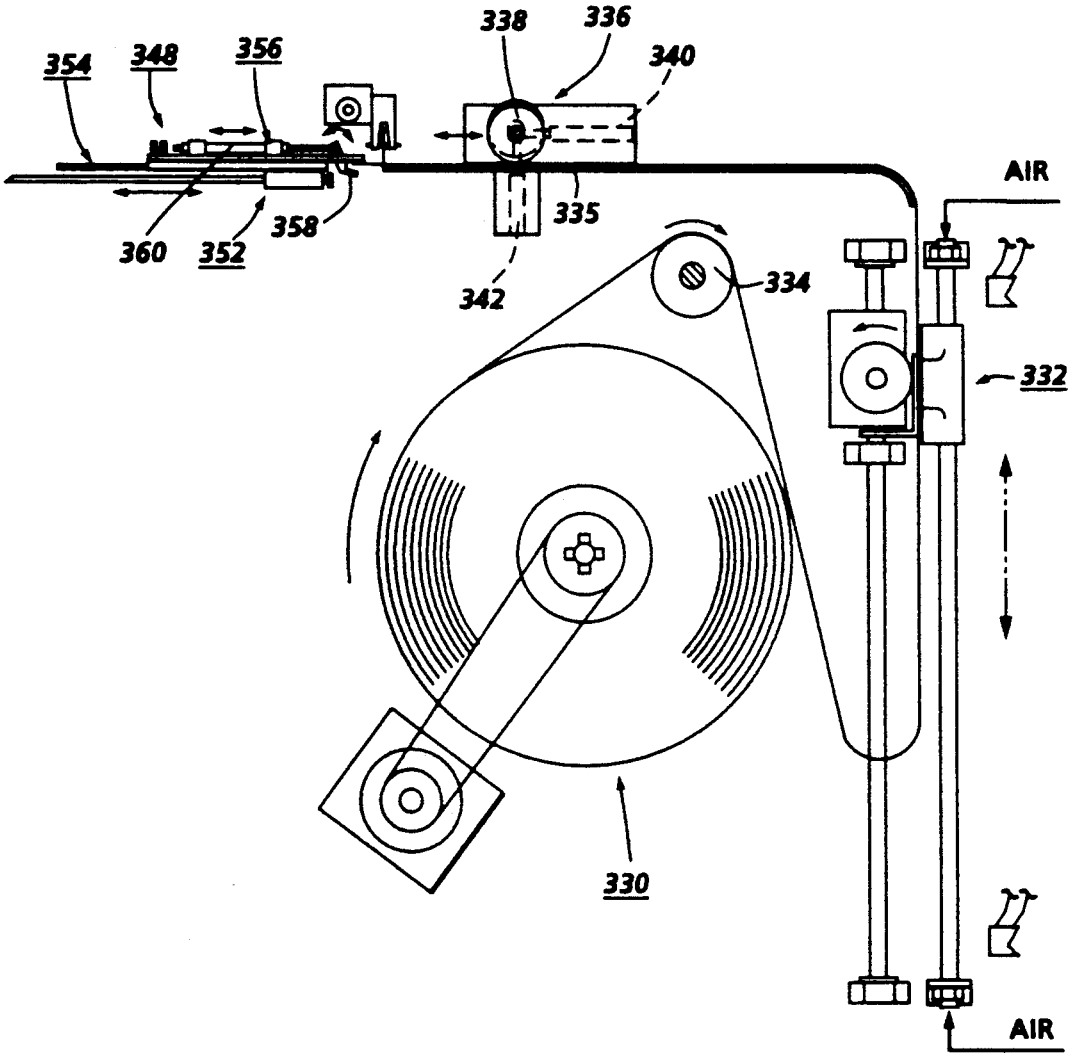
FIG. 11 is a schematic, elevational view of an assembly for feeding tissue paper to a tissue paper transporting assembly.
Figure 12:
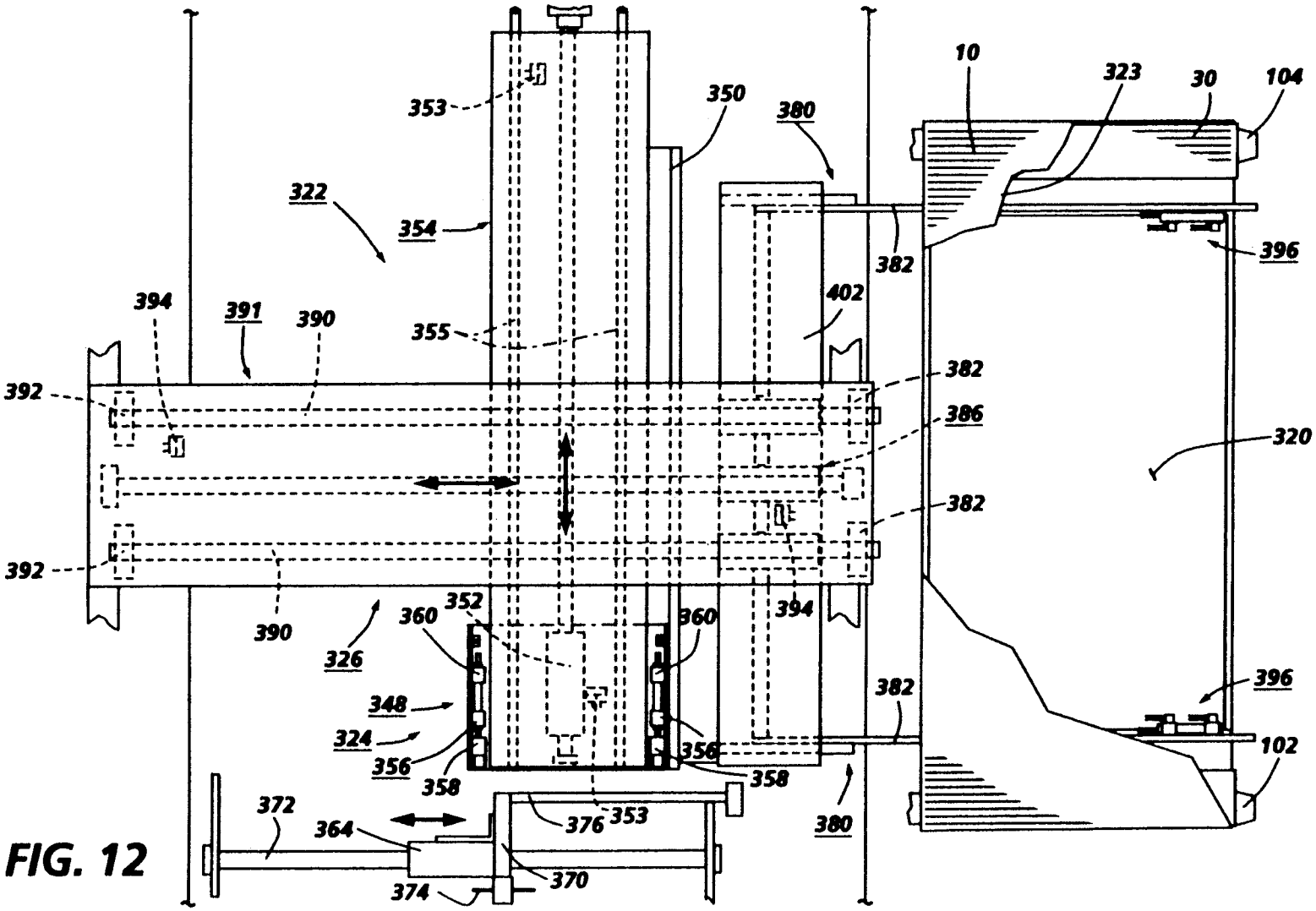
FIG. 12 is a schematic, overhead plan view of the tissue paper transporting assembly.
Figure 13:
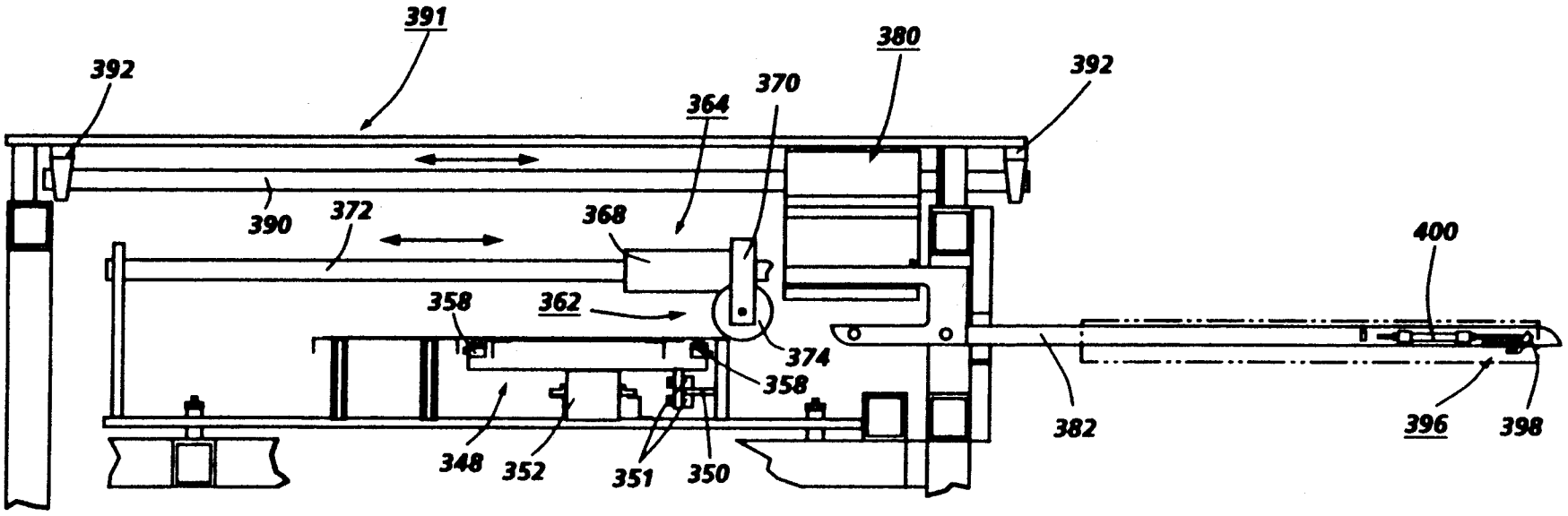
FIG. 13 is a schematic, side view of the tissue paper transporting assembly.

Referring to FIGS. 11-13, a tissue paper feed assembly 322, allowing for accomplishment of the above-mentioned object by providing for the automatic insertion of the sheet of tissue paper 320 into a cavity 323 (FIG. 5) formed by the extended belt 10, is shown. The tissue paper feed assembly 322 (FIG. 11) includes a transport mechanism 324 and an inserting mechanism 326. The tissue paper is supplied from a tissue paper supply 330 to a dancer roller mechanism 332 by way of an idler roller 334. The dancer roller mechanism 332 is equivalent in structure to the dancer roller mechanism 178 described above. The tissue paper is drawn from the dancer roller mechanism 332, across a baffle 335, by a roller mechanism 336. The roller mechanism 336 includes a roller 338, the roller 338 being operatively coupled to both a mechanical over-running or one-way clutch (not shown) and an air cylinder 340. In the preferred embodiment, the roller 338 is selectively positioned in contact with the tissue paper by way of an air cylinder 342.

The leading edge of the tissue paper can be transported, by a carriage 348 (FIGS. 11 and 12), from a point adjacent the second finger 102 to a point adjacent the extended third finger 104. The carriage 348 is slideably mounted to a support strip 350 (FIG. 13) by way of rollers 351, and driven by a drive mechanism 352. In one example, the drive mechanism 352 is equivalent structurally to the rodless cylinder arrangement 186, and includes a pair of limit switches 353 for sensing the extent to which the carriage 348 is displaced. The carriage 348 (FIGS. 11 and 12) is slideably mounted to a tissue paper support table 354, the support table 354 being coupled to the support plate 120 by way of support rails 355. A pair of clamping mechanisms 356 are mounted operatively along edges of the carriage 348. Each of the clamping mechanisms 356 include a clamp 358 that can be selectively biased into a clamped position by an air cylinder 360. Referring specifically to FIG. 11, the carriage 348, in its home position, is located proximate the edge of the baffle 335 so that the leading edge of tissue paper supply can be engaged by the clamps 358 when the leading edge is disposed just beyond the edge of the baffle 335.

Referring again to FIGS. 12 and 13, sheets of tissue paper 320 are cut from the tissue paper supply with a cutting mechanism 362. The cutting mechanism 362 includes an appropriate drive mechanism 364, such as the type used in the rodless air cylinder arrangement 186, which drive mechanism 364 includes a saddle 368 and a yoke 370. The saddle 368 is slideably, magnetically coupled to a hollow tube 372, while the yoke 370 is coupled with the saddle 368. The yoke 370 serves to support both a rotatable cutting disk 374 and a displacement mechanism 376. As the yoke 370 is extended forward, the displacement mechanism 376 displaces portions of the cores 30 positioned on the fingers 100, 102 and 104. In its home position, the cutting disk 374 is retracted so that the tissue paper supply can pass freely thereby.

The edge of the sheet 320 facing the belt 10 is clamped by a pair of arm mechanisms 380. Each arm mechanism 380 includes an arm 382 operatively connected to a rodless cylinder 386. The arm mechanisms 380 are slideably mounted to a pair of rails 390, the rails 390 being mounted to a mounting table 391 by a plurality of guides 392. The displacement of the arms 382 is sensed by the limit switches 394. A clamp mechanism 396 (FIG. 13), which is structurally equivalent to the clamp mechanism 356, is located at the end of each arm 382. Each clamp mechanism 396 includes a clamp 398, which clamp 398 can be biased into an open position or a closed position by an air cylinder 400. In the preferred embodiment, the arms 382 are positioned above the cut sheet 320, and when the arms 382 are in their home position, the long edge of the sheet 320, adjacent the belt 10, can be engaged and clamped by the clamp mechanisms 396. A charging device, such as a corotron 402, is disposed proximate a forward portion of the mounting table 391 so that the arms 382 pass thereunder as they are displaced from their home position into the hollow cavity 323.

Figure 8C:
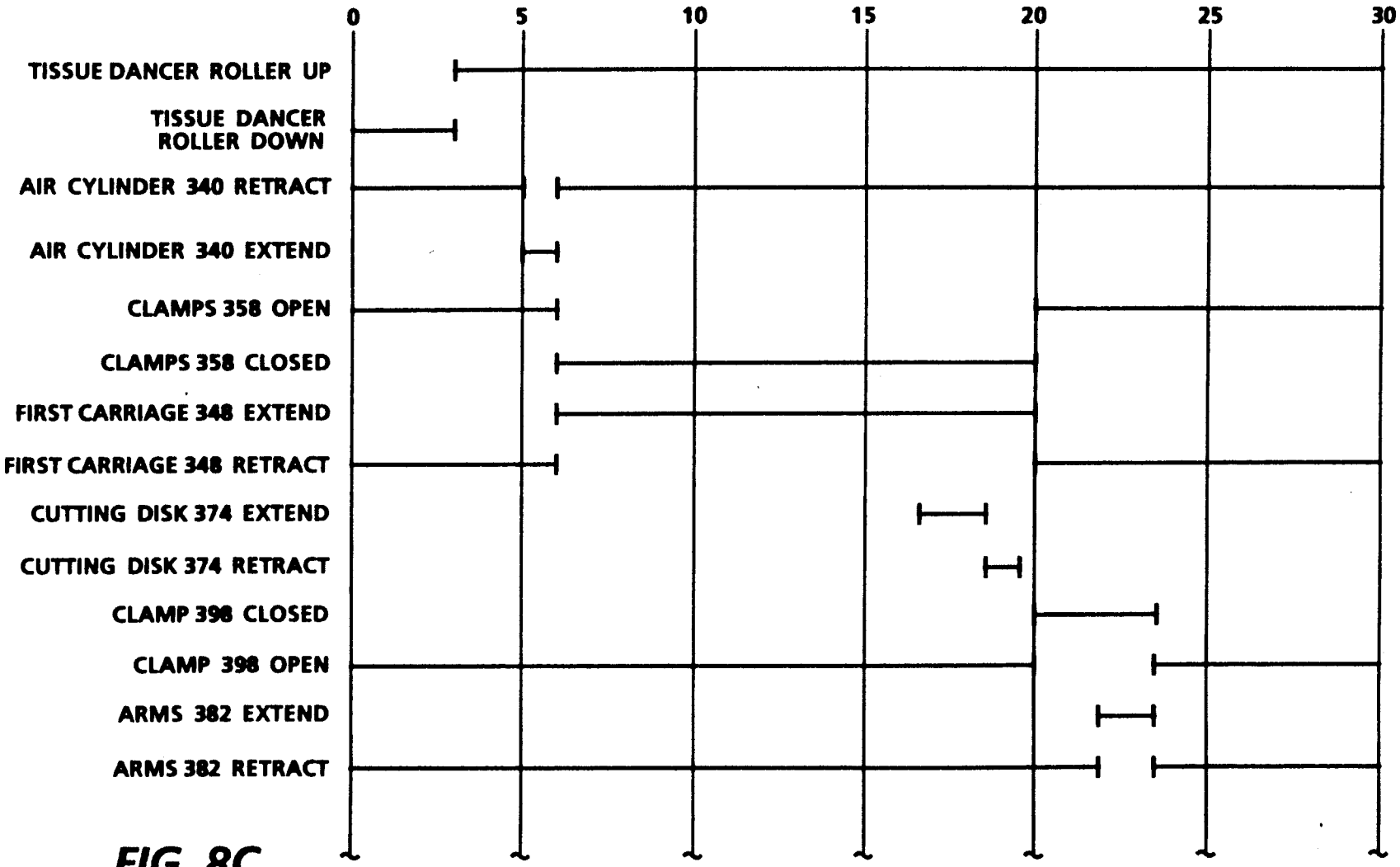

Referring to FIGS. 11-13 and 8B-8C, the preferred form of operation of the tissue paper feed assembly 322 is explained in further detail. Referring specifically to FIGS. 8B-8C, it should be understood that the process of tissue paper insertion is performed just after latch 160 is released and prior to the moment that the turret 108 is rotated. When using the processes of FIGS. 8B and 8C conjunctively, optimum operation can be achieved by coordinating the respective steps of FIGS. 8B and 8C so that the sheet 320 can be inserted into the hollow cavity 323 soon after latch 160 has been released. That is, the sheet 320 should preferably be engaged by the clamps 398 concurrent with the hollow cavity 323 being formed.

In the case of initial startup for the process of FIG. 8C, the function of the dancer roller mechanism can be achieved by manually pulling down a length of tissue paper. The tissue paper can then be threaded through the roller mechanism 336 so that the leading edge of the tissue paper supply is positioned along the line across which the cutting disk 374 is traversed. As will be recognized from the discussion below, after initial startup, all of the steps of FIG. 8C can be performed automatically.

To deliver the leading edge of the tissue paper supply to the edge of the baffle 335, the roller 338 is displaced toward the edge of the baffle 335 by the air cylinder 340. Since the one-way clutch remains locked as the roller 338 is being displaced toward the edge of the baffle 335, the tissue paper slides with the roller 338. As the air cylinder 340 is retracted, the one-way clutch unlocks so that the roller 338 rolls back freely over the tissue paper without substantially displacing the tissue paper. Upon delivering the leading edge of the tissue paper to the edge of the baffle 335, the leading edge is engaged and clamped by the clamps 358, and the carriage 348 is driven from the point proximate the second finger 102 to the point proximate the third finger 104.

As the carriage 348 is driven forward, the upper surface of the support plate 354 provides support for the tissue paper. Once the leading edge of the tissue paper has been fully extended by the carriage 348, the saddle 368 is extended from its home position, and then retracted, so that the sheet of tissue paper 320 is formed by the cutting action of the cutting disk 374. During the extension of the saddle 368, the displacement mechanism 376 operatively contacts the back of the cores 30 positioned on the fingers 100, 102 and 104 so that the wrapped belt product can be discharged into the receiving bin 22.

Subsequent to cutting the sheet 320, the long edge of the sheet 320 is clamped by the clamps 398, and the arms 382 are urged toward the cavity 323 of belt 10 so that the sheet 320 passes under the corotron 402. As the sheet 320 is passed through the corotron 402, it is charged so that the sheet 320 adheres to an inner surface of the belt 10, as described below. After the arms 382 are extended into the cavity, the sheet 320 is released from the grip of the clamps 398. The arms 382 are then retracted to their home position in anticipation of receiving another sheet 320.

Figure 14A:
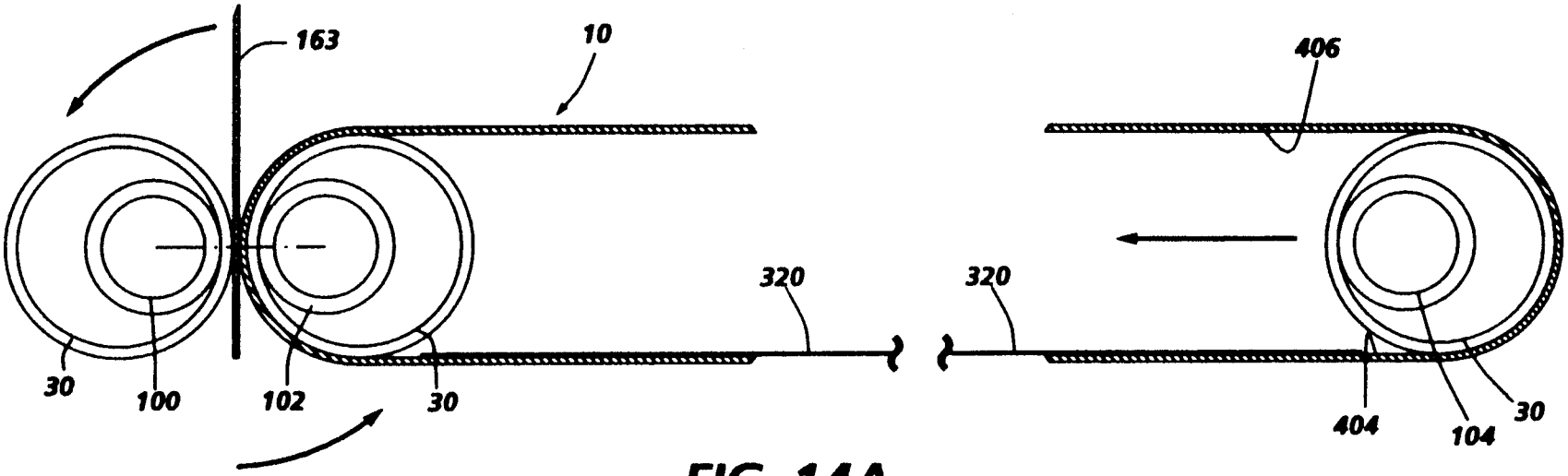
FIGS. 14A-14C are schematic, fragmentary, elevational views of the apparatus depicting the process employed to entrain the loop, sheet of protective paper and sheet of tissue paper about the three cores.
Figure 14B:
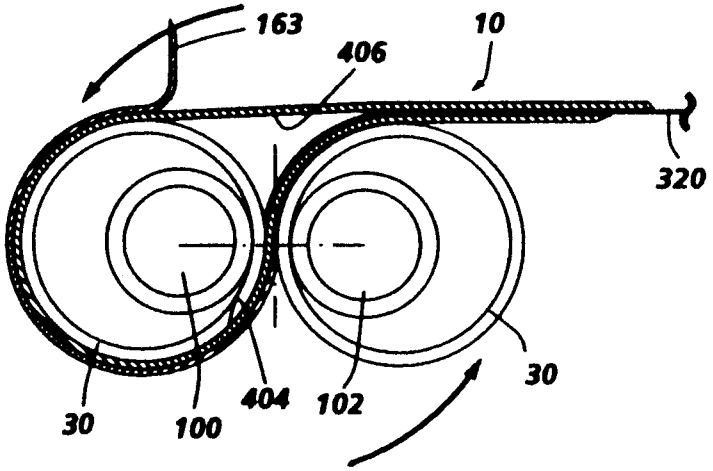
Figure 14C:
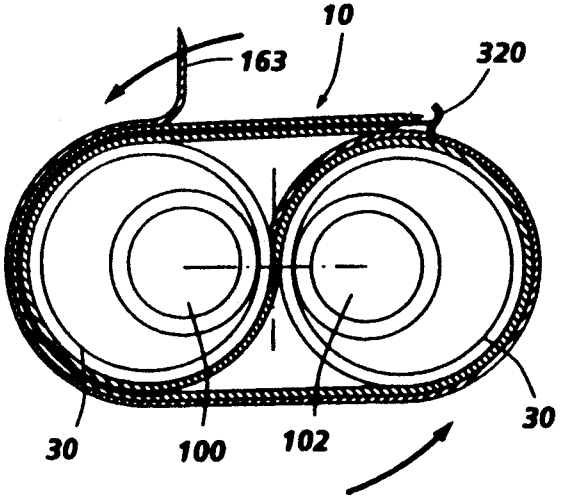

Referring to FIGS. 14A–14C, an example of the entraining of the sheet 320 with belt 10 is shown. Once the sheet 320 is released from the clamps 398 of arms 380, it falls, as a result of gravitational force, onto a lower inner surface 404 of belt 10. When the fingers 100 and 102 are rotated in a counter-clockwise direction about axis 118, the lower inner surface 404, as well as an upper inner surface 406, are drawn toward the fingers 100 and 102. Due to static and/or frictional forces between the sheet 320 and the lower inner surface 404, the movement of the sheet 320 follows the movement of the lower inner surface 404. In particular, continued rotation of fingers 100 and 102 causes the sheet 320 to be dragged toward, and eventually wrapped around the fingers 100 and 102. As best illustrated in FIG. 14C, as the sheet 320 is wrapped about the fingers 100 and 102, it becomes sandwiched between the inner surfaces 404 and 406 of the belt 10.

What is claimed is:

1. An apparatus for wrapping a precut sheet with an endless flexible member having opposed surfaces in which the endless flexible member is positioned adjacent said apparatus and is selectively disposed in one of an unwrapped position and a wrapped position so that the precut sheet can be positioned on a portion of the endless flexible member while the endless flexible member is in the unwrapped position, comprising:

a guide path extending from a remote location, spaced from the endless flexible member in the unwrapped position, to a location disposed adjacent the endless flexible member in the unwrapped position;

means for supporting the endless flexible member with the opposed surfaces being spaced from each other;

means, movably coupled with said guide path, for receiving and holding the precut sheet, said receiving and holding means moving relative to said guide path and including a pair of arms for releasably clamping the precut sheet;

means for moving said receiving and holding means adjacent the endless flexible member in the unwrapped position so that said pair of arms and the precut sheet are superposed relative to the portion of the endless flexible member and between the opposed surfaces;

means for releasing the precut sheet from said pair of arms so that the precut sheet is positioned on the portion of the endless flexible member and between the opposed surfaces; and means for wrapping the endless flexible member about itself with the precut sheet interposed between the opposed surfaces of the endless flexible member.

2. The apparatus of claim 1, wherein the endless flexible member is a photoreceptive belt.

3. The apparatus of claim 1, further comprising:

means for transporting a length of separator material;

means for supplying the length of separator material, said supplying means being adapted to deliver a free edge of the separator material to a location adjacent said transporting means; and means for cutting the separator material along an edge opposing the free edge to define the precut sheet.

4. The apparatus of claim 3, further comprising means for reciprocating said cutting means transverse to the length of the separator material.

5. The apparatus of claim 3, wherein said transporting means comprises:

a carriage for transporting the length of separator material in a direction substantially parallel to a long axis of the flexible member; and means for engaging and clamping the free edge of the separator material, said engaging and clamping means being coupled with said carriage.

6. The apparatus of claim 5, further comprising means for selectively biasing said engaging and clamping means into one of an open position and a closed position.

7. The apparatus of claim 5, further comprising automatic drive means for driving said carriage from a location adjacent one end of the endless flexible member in the unwrapped position to a location adjacent the other end of the flexible member in the unwrapped position.

8. The apparatus of claim 1, further comprising means, mounted to portions of said arms, for engaging and clamping an edge of the precut sheet.

9. The apparatus of claim 8, wherein said engaging and clamping means includes means for selectively biasing said engaging and clamping means into one of an open position and a closed position.

10. The apparatus of claim 1, in which the precut sheet possesses a charge, further comprising means, positioned in said guide path, for substantially neutralizing the charge of the precut sheet as it is passed therethrough.

11. The apparatus of claim 10, wherein said neutralizing means comprises a corotron.

12. The apparatus of claim 1, wherein the precut sheet comprises a sheet of tissue paper.

* * * * *